United States Patent [19]

Biggar, III

[11] 4,346,855

[45] Aug. 31, 1982

[54] STRIPPING METHOD AND APPARATUS FOR THE PROCESSING OF A CONTINUOUS LAMINATED WEB

[75] Inventor: Frank M. Biggar, III, Lakeview, N.Y.

[73] Assignee: Elizabeth S. Biggar, Hamburg, N.Y.

[21] Appl. No.: 172,026

[22] Filed: Jul. 24, 1980

[51] Int. Cl.[3] ..... B65H 17/02; B65H 17/20; B65H 27/00

[52] U.S. Cl. ..... 242/67.2; 156/267; 156/510; 226/199; 242/76

[58] Field of Search ..... 242/67.1 R, 67.2, 67.3 R, 242/76, 55, 59, 56.5, 56.4; 226/197, 199; 225/99; 83/870, 874; 156/267, 254, 510, 344, 247

[56] References Cited

U.S. PATENT DOCUMENTS

| | | | |
|---|---|---|---|
| 1,630,713 | 5/1927 | Meyer | 226/197 X |
| 3,360,210 | 12/1967 | Frisbie | 242/67.3 R X |
| 3,679,116 | 7/1972 | Hamlin et al. | 226/199 X |
| 3,954,213 | 5/1976 | Anderson | 226/197 X |
| 3,966,534 | 6/1976 | Oddy | 156/267 X |
| 4,170,504 | 10/1979 | Riggs | 242/55 X |
| 4,246,058 | 1/1981 | Reed | 156/267 X |

*Primary Examiner*—John M. Jillions
*Attorney, Agent, or Firm*—Rogers, Eilers & Howell

[57] ABSTRACT

A method and apparatus in the processing of a continuous web and specifically a method and apparatus for stripping a waste matrix from a web substrate such as in the production of labels. The matrix is separated from the substrate and skewed as it is separated such that one side edge of the matrix is stripped from the substrate upstream of its other side edge. The apparatus of the invention provides adjustability of the skewing angle for optimum conditions.

43 Claims, 5 Drawing Figures

10
22
74
58
30
56
114
112
34
110
108
116
104
96
102
98
100
52
94
46
50
88
86
84
82
80
92
90
44
26
42
42
40
40
124
32
64
68
62
60
72
70
28
14
28
132
120
132
130
48

STRIPPING METHOD AND APPARATUS FOR THE PROCESSING OF A CONTINUOUS LAMINATED WEB

BACKGROUND AND SUMMARY OF THE INVENTION

This invention relates to the processing of a continuous web, and more particularly a laminated web which may be of paper or the like. While the present invention may have many applications, it will be described primarily in the manufacture of labels.

In the manufacture of labels, a laminated web, having an upper laminae overlying a substrate, is fed from an unwind roll to the processing machine. The web is such that the laminae is adhered to the substrate by a suitable adhesive, but is easily stripped or peeled from the substrate without damage to either layer. The compositions of the layers are such that nearly all the adhesive remains with the laminae so that a label can be peeled off the substrate and then placed on the object to which it is to be applied such as a container or the like.

The processing machine into which the laminated web is fed, may have several stations which perform various operations on the web as the web travels therethrough. For example, there may be one or more printing stations, cross-perforating, line hole punching, die-cutting, and matrix stripping. It is the matrix stripping operation to which this invention relates.

In a die-cutting station, the upper laminae of the web is die-cut by a rotating die and/or reciprocating dies which penetrates the laminae but not the substrate. This leaves a die-cut pattern defining the shape of the labels, and a waste matrix. At the stripping station the matrix is removed or separated from the web leaving only the substrate and the label portions which may then be further processed onto a rewind roll, by folding, by sheeting, or the like. It is readily appreciated that productivity is directly related to machine speed, and that the machines can be operated at a speed only as fast as the operation station with the least capability. Thus, if one operating station cannot exceed a certain speed, the entire machine will have to be run at that speed even though other operating stations will operate faster. One of the weak links as far as operating speed is concerned has been the stripping station, and this is particularly so where the waste matrix is relatively weak.

The configuration and strength of the waste matrix depends on the die pattern which, because of some job requirements leaves a relatively weak matrix that breaks quite easily or tends to "ride" to the center of the rewind roll. For example, if the matrix includes vertical strands of substantial width, its strength will be sufficient to allow relatively high speed operation, but if there are very few longitudinal strands and they are quite thin, the matrix will easily break and the speed of the machine will have to be reduced substantially to prevent such breakage. Also, if there are only two outside longitudinal strands with no longitudinal strands therebetween, these strands tend to move toward each other causing the rewind matrix roll to bulge at the center. Thus, it is a primary purpose of the present invention to provide a method and apparatus for stripping the matrix from the web at speeds substantially greater than with the conventional method with a corresponding increase in productivity, and where the tendency for the rewind matrix roll to bulge is greatly reduced if not eliminated.

Heretofore, the matrix was stripped from the substrate by passing the matrix over a stripper bar oriented parallel to the plane of the web and normal to the direction of web travel. This meant that the matrix was separated along an axis in the plane of the web which was normal to the direction of web travel. In accordance with the method and apparatus of the present invention, the matrix is separated such that one of its side edges is stripped or peeled from the substrate upstream of its other side edge. This means that the matrix is separated and skewed by turning it away from the substrate along a skewed axis, i.e., an axis other than normal to the direction of web travel. The "skewing angle", which is the angle between the axis in the plane of the web normal to the direction of web travel and the axis in the plane of the web along which the matrix separates, is adjustable so that the optimum skewing angle can be selected for each job, for it has been found that the optimum skewing angle will vary from job to job depending on the matrix configuration.

It is an important aspect of the invention that the skewing angle can be quickly, easily and conveniently selected for optimum conditions. The apparatus of the invention includes a stripper bar and a matrix rewind control assembly, each of which is independently pivotally adjustable for accurate control of the skewed matrix.

It has been found that with the present invention the speeds of operation are substantially increased over the conventional method. The effects of laminae strength, die configuration, and release characteristics are greatly reduced. The result is substantially increased productivity due to increased speed and less downtime from web breakage and other problems. It also makes it possible to operate with a weaker matrix with corresponding savings in web material and more efficient use of machinery, such as dies and the like. Moreover, the skewing tends to hold the longitudinal matrix strands separated for uniform rewinding of the matrix.

These and other objects and advantages of the method and apparatus of the invention are shown by the drawings and detailed description to follow.

DETAILED DESCRIPTION OF A PREFERRED EMBODIMENT

With reference to the drawings, and as previously stated, a preferred embodiment of the invention will be described with reference to the production of labels, although the invention has application in other areas as well.

There is shown the stripper apparatus 10 for the processing of a continuous laminated web 12 which may be of paper or the like, such as used in the manufacture of labels. The web has a base sheet of substrate 14 and laminae or top sheet 16 which are releasably joined by a suitable adhesive. The compositions of the laminae and substrate are such that the two can be separated with nearly all of the adhesive remaining on the back side of the laminae so that the labels can be peeled from the substrate and thereafter applied, such as to containers.

Figure 1:
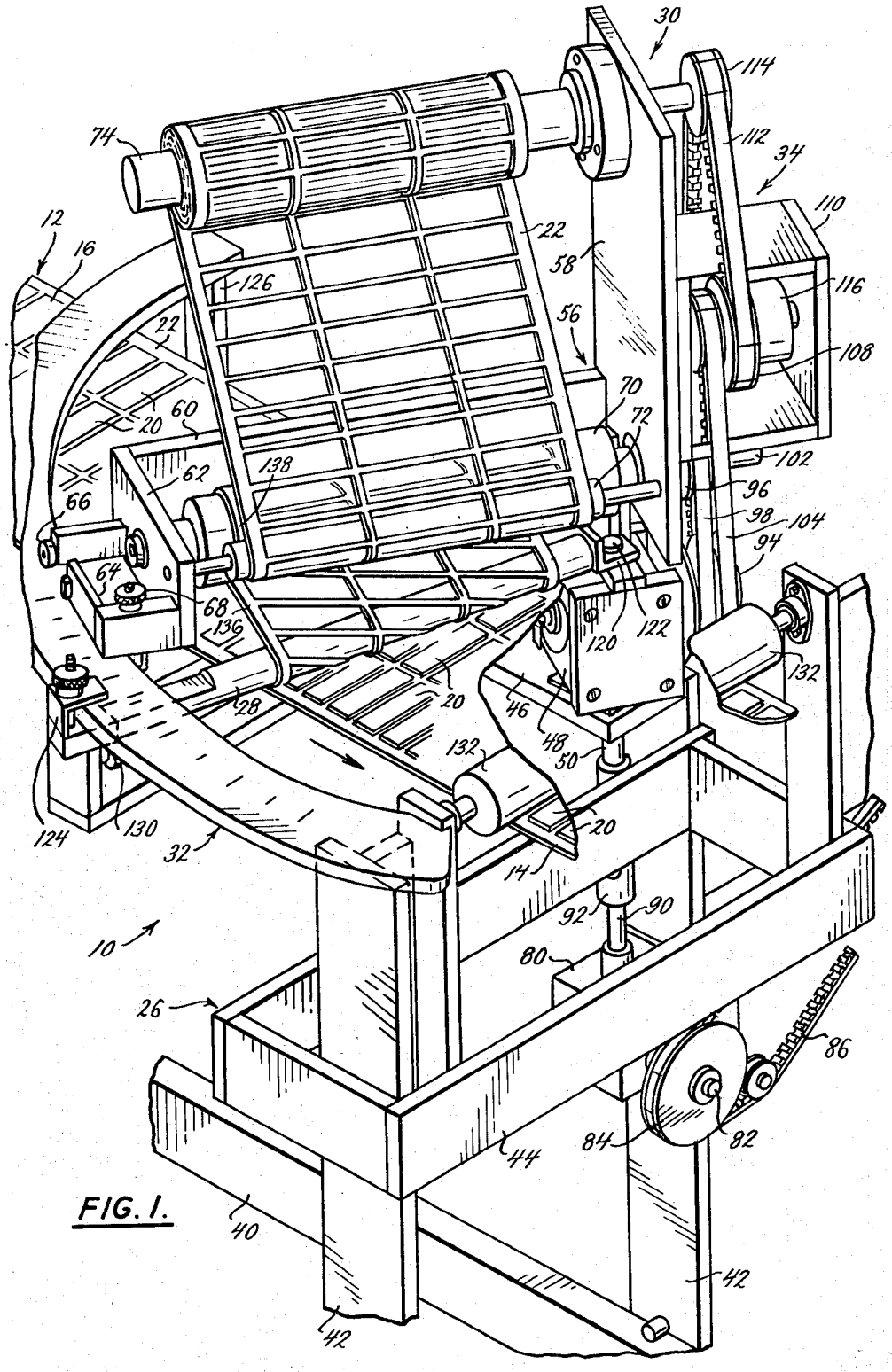
FIG. 1 is an isometric view of the stripper apparatus of the present invention.
Figures 2, 4, 5:
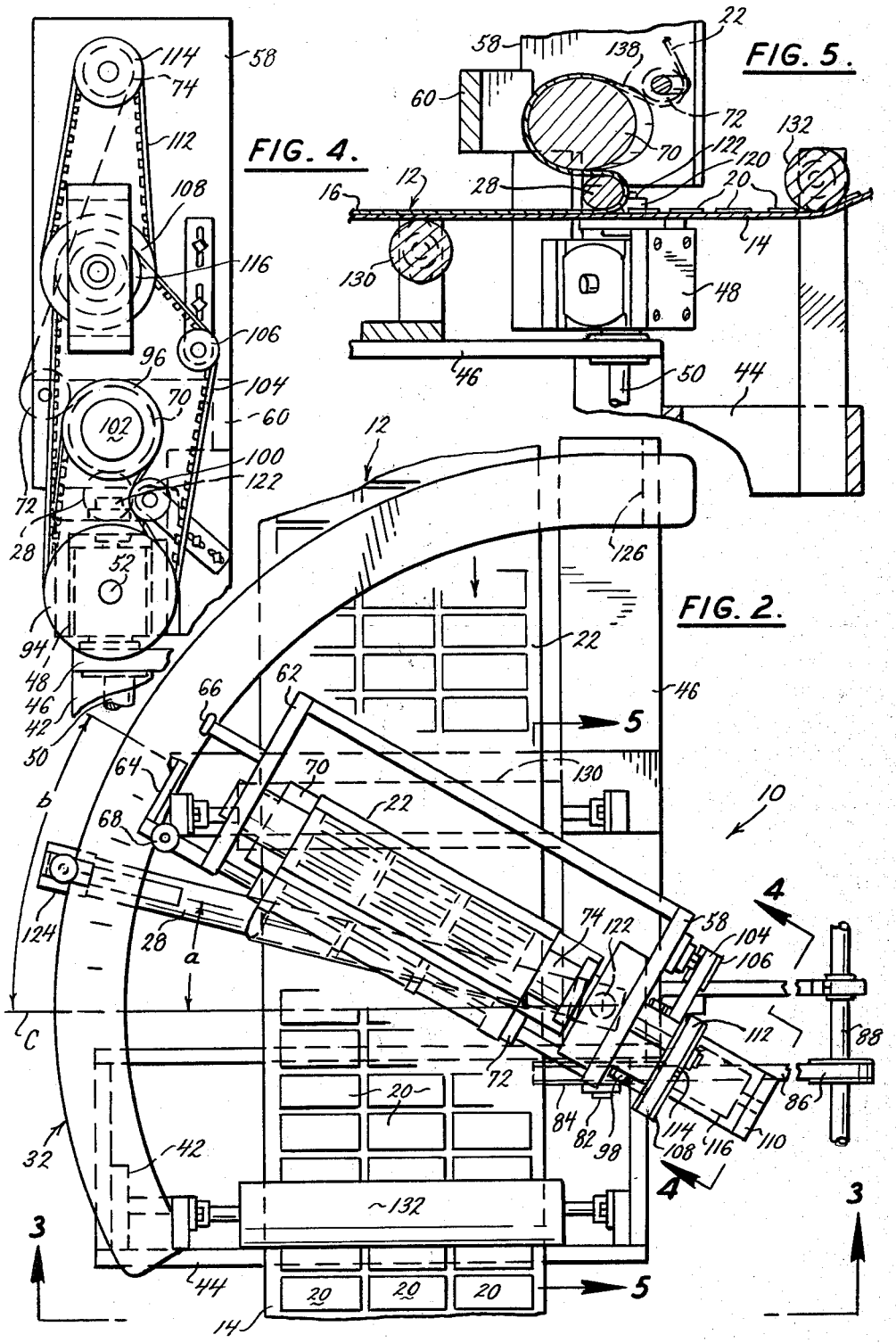
FIG. 2 is a plan view of the apparatus of FIG. 1.
FIG. 4 is a view in section taken generally along the line 4—4 of FIG. 2.
FIG. 5 is a view in section taken generally along the line 5—5 of FIG. 2.

The web 12 is traveling from left to right as viewed in FIG. 1 and as shown by the arrows of FIGS. 1 and 2. It is to be understood that the web has been previously processed at one or more other processing stations, and that it has been die-cut with a selected die pattern with the die cutting through the laminae but not the substrate. For example, the die pattern might be such as to produce labels of a selected shape. For purposes of illustration only, the labels are shown to be rectangular. Thus, the die cut web upstream from the stripper apparatus defines label portions 20 and a matrix portion 22. The purpose of the stripper apparatus is to separate the matrix from the substrate, leaving only the labels 20 on the substrate for further processing such as rewinding, folding, sheeting, or the like.

Generally, the stripper apparatus 10 includes a base frame 26 through which the web travels and to which is pivotally mounted a stripper bar 28 for stripping the matrix from the substrate, a matrix rewind control unit 30 for controlling the stripped matrix and rewinding it onto a roll, a circular track segment 32 for adjustably securing the stripper bar and rewind control unit at selected angular positions, and a drive assembly 34 for rotatably driving certain rolls which are part of the rewind control unit.

Figure 3:
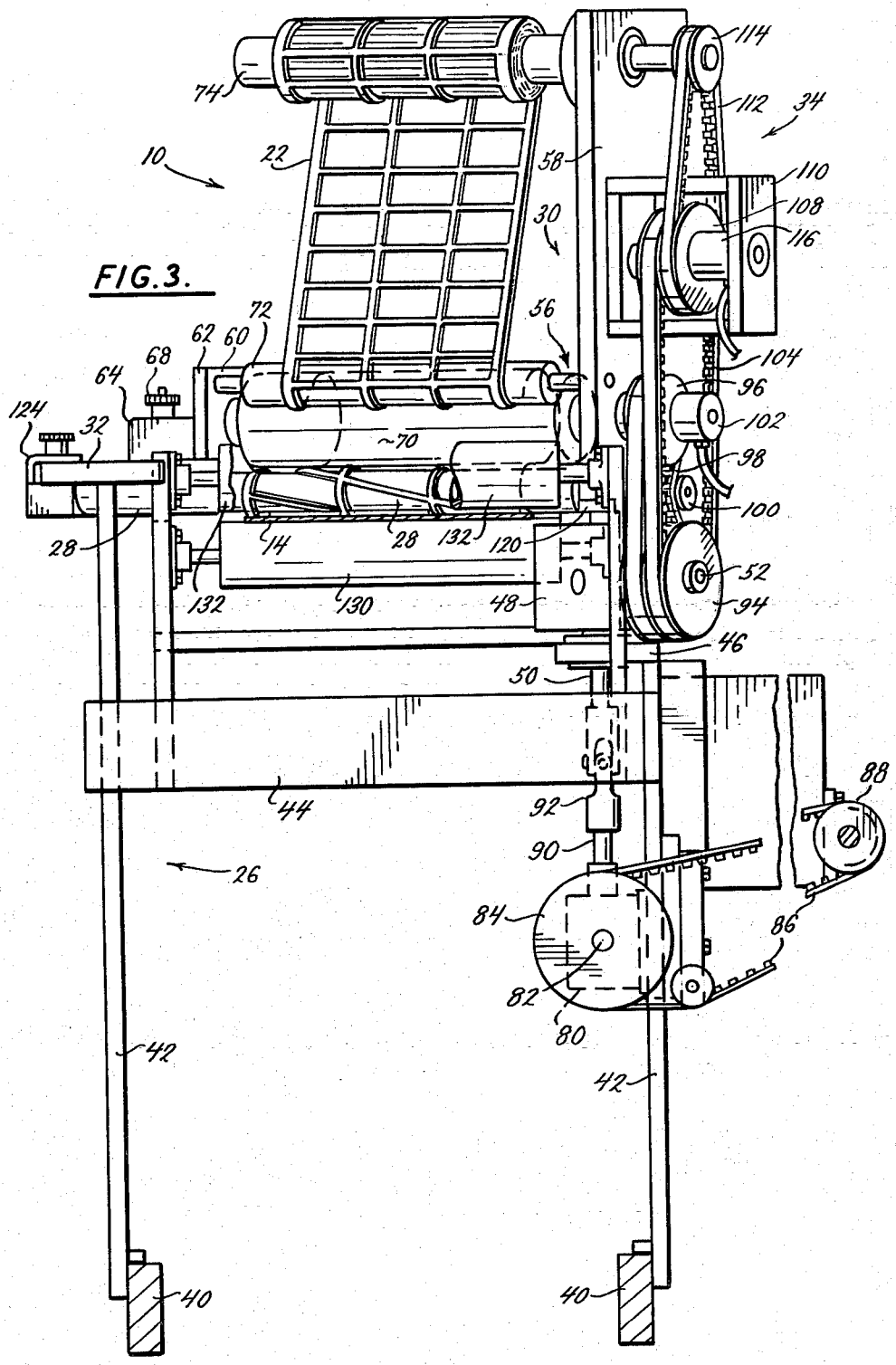
FIG. 3 is a right end elevation view with reference to FIG. 1 taken generally along the line 3—3 of FIG. 2.

More specifically, the frame 26 includes parallel side frame members 40 and vertical side frame members 42. Additional frame support is provided by a rectangular structure 44 near the upper ends of the uprights 42. Secured to spaced uprights 42 at one side of the machine, is a horizontal plate 46 to which is pivotally mounted the housing of a right angle gear box 48. The gear box 48 has an input shaft 50 and an output shaft 52 (FIGS. 3 and 4), the input shaft being generally vertically oriented. Thus, the gear box 48 is mounted to the frame member 46 to allow both rotation of the input shaft 50 relative to the frame and housing, as well as pivotal movement of the housing relative to the frame about the rotating axis of the input shaft.

The rewind control unit includes a support assembly 56 having a vertical plate 58 and an arm 60 extending therefrom over the web. An outer arm 62 is secured to the arm 60 and extends generally parallel to the vertical plate 58 so that the plate 58 and arm 62 provide means for mounting rollers to be further explained. A C-clamp and roller assembly 64 is mounted to the outer plate 62 and has a small roller 66 for riding on the track 32. The C-clamp assembly 64 also has a securing device such as a setscrew 68 for adjustably securing the support unit 56 in a selected angular position as will be more fully explained.

The rewind control unit further includes a pull roll 70 and idler roll 72 rotatably mounted between the vertical plate 58 and the outer arm 62, each supported at both ends in suitable bearings. The pull roll has a suitable friction surface for gripping the matrix and, as will be further explained, is driven to pull the matrix from the substrate. As will be noted, the idler roll 72 is spaced somewhat downstream of the pull roll, and its purpose is to provide sufficient wrap of the matrix about the pull roll to insure gripping of the matrix. Near the top of the vertical plate 58 is rotatably mounted, in a suitable bearing, a rewind roll 74 onto which the matrix is rewound. This roll is also driven as will be further explained.

The drive assembly 34 includes another right angle gear box 80 having an input shaft 82 driven by a pulley 84 and timing belt 86 from the line drive 88 of the web processing machine. The output shaft 90 from the gear box 80 drives the input shaft 50 of the gear box 48 through a universal joint 92. The output shaft 52 of the gear box 48 has a double pulley 94 which drives both the pull roll 70 and rewind roll 74. Hence, the pull roll 70 is driven from a pulley 96 which in turn is driven from the pulley 94 through a timing belt 98 and idler roller 100. An air clutch 102 controls the drive of the pull roll by the air pressure supplied to the clutch to selectively control its speed. Another timing belt 104, engaging the pulley 94 and an idler 106, drives a double pulley assembly 108 rotatably mounted in a rectangular bearing support 110 secured to the back of the plate 58. The rewind roll 74 is driven from the double pulley 108 through a timing belt 112 and a pulley 114. Another air clutch 116, located at the double pulley 108, controls the drive to the rewind roll by the air pressure to the clutch to provide relative speed adjustment for the rewind roll.

Thus, it will be seen that the entire matrix rewind control unit 30, including the support 56 and rollers 70, 72, and 74, and that portion of the drive from the input shaft of the gear box 48 to the pull and rewind rolls, all can pivot as a unit about the rotating axis of the input shaft 50 for purposes to be more fully explained.

The stripper bar 28 is also mounted for pivotal movement about the same rotational axis of the input shaft 50. Thus, the pivotal end of the stripper bar has a bracket 120 having an opening which receives a pin 122 at the top of the gear box 48. The axis of the pin 122 is aligned with the rotating axis of the input shaft 50. The stripper bar 28 extends over the web and has a C-clamp 124 at its outer end for adjustably securing the bar to the track segment 32 at selected angular positions for purposes to be further explained. The stripper bar 28 does not rotate, but has a low friction surface, such as TEFLON, so that the matrix will move easily over the bar. The bracket and pin arrangement 120–122 provides means for easy removal and replacement of the bar 28 so as to accommodate stripper bars of various diameters.

The circular track segment 32 has its center defined by the pivotal axis which, in turn, is defined by the rotating axis of the input shaft 50, and is supported at its ends to the frame 26 by upright members 42 and 126.

It will be noted that the web 12 is generally flat (horizontal in the described embodiment) as the web travels through the stripper apparatus, such as at the location of the stripper bar 28. To maintain the web in this orientation, the web 12 travels over a roller 130 mounted within the frame just beneath the web at the entrance of the apparatus, and travels just beneath a roller 132 as the web leaves the apparatus. While in this preferred embodiment, the plane defined by the web is generally horizontal as it travels through the stripper apparatus, and the pivot axis of the stripper bar and rewind control unit is generally vertical, it is to be understood that the web could be inclined in which case the pivot axis should remain normal to the plane of the web so that the stripper bar and rollers remain generally parallel to the web as their angular positions are adjusted. Moreover, a sufficient portion of the web at the location of the stripper bar should remain in the same orientation as it travels through the apparatus so that the bar can be pivotally adjusted throughout the desired range while remaining generally parallel to the web at the location of the bar.

The stripper bar 28 preferably should be in relatively close proximity to the upper surface of the web so that the separation of the matrix from the substrate occurs relatively close to the bar. As previously indicated, the apparatus allows for easy replacement of stripper bars of various diameters so that various speeds of separation of the matrix from the substrate can be selected. For example, stripper bars of diameters from one to three and one-half inches (2.54 to 8.89 cm) may be selected. Also preferably, the relative positions of the bar 28 and rolls 70 and 72, are such that the matrix as it travels between the bar and the pull roll 70 is approximately parallel to the web at the location of the stripper bar. The matrix portion, designated 136, may not be exactly parallel, depending on the diameter of the stripper bar, but maintaining it approximately parallel will make it easier to adjust the angle of the unit 30, and thus the angle of the pull roll 70, for uniform web tension, and will also insure sufficient wrap of the matrix on the pull roll. It is also preferable that the matrix portion 138, as it travels between the pull roll 70 and idler roll 72, be generally parallel to the web at the location of the stripper bar, also to insure sufficient wrap of the matrix about the pull roll.

The rollers 70 and 72 are located relatively close to the stripper bar for close control of matrix tension as it is stripped or pulled from the substrate. The rewind roll 72 is spaced from rolls 70 and 72 a sufficient distance to allow for accumulation of the matrix thereon. By the air clutches 102 and 116, the speed of the pull roll 70 and rewind roll 72 can be very closely controlled to adjust the matrix tension all along its path from the stripper bar to the rewind roll.

OPERATION

In the operation of the stripper apparatus, the web travels into the apparatus beneath the stripper bar. The substrate and labels proceed downstream and under the roller 132 for further processing. The matrix is separated and skewed from the substrate at the location of the stripper bar, passes around and over the stripper bar back toward the pull roll, around the pull roll and forwardly toward the idler roll, and thence around the idler roll to the rewind roll.

As the matrix is separated from the substrate at the location of the stripper bar, it is skewed relative to the web. The amount of skewing is defined by the "skewing angle" of the stripper bar. This is the angle a shown in FIG. 2 and is the angle between an axis C in the plane of the web normal to the direction of web travel at the location of the stripper bar and the axis in the plane of the web along which the matrix separates. In this preferred embodiment, this skewing angle may be selected within a wide range of angles by pivotally adjusting the stripper bar 28. The rewind control unit 30 is pivotally adjusted to an angle b relative to the reference C which may be approximately twice the skewing angle a, although it may vary plus or minus a few degrees from this relationship due to irregularities and distortions in the matrix. Both the stripper bar 28 and the unit 30 are pivotally adjustable along the track segment 32 and secured by the C-clamps 64 and 124 in the desired angular relationships a and b. The track segment 32 acts as a protractor and may have a suitable scale on its surface.

By skewing the matrix as it is separated from the substrate by the stripper bar 28, it has been found that superior separation is achieved enabling substantially greater running speeds than conventional stripper machines that have no adjustability and separate the matrix along the normal axis. It is an important feature of this invention that the skewing angle a and the angle b can be easily selected from within a range of angles. In this described embodiment, with the reference C as the zero degree or normal reference, the angle b can be selected from between zero and ninety-degrees. With the angle b approximately twice that of the angle a, the angle a can be selected from between zero and forty-five degrees.

It will be noted that in the described embodiment, these angular adjustments are made upstream of the web. This is because it gives the machine operator, who usually stands downstream, good visibility of the apparatus during operation. However, it is also possible to pivotally adjust the stripper bar and rewind control unit downstream relative the web by extending the track segment at the downstream end and by making suitable modifications that would be evident to those skilled in the art in view of this described embodiment.

It is another important feature of the invention that the angular positions of the stripper bar and rewind and control unit may be adjusted while the apparatus is operating, i.e., while the pull roll 70 and rewind roll 74 are driven. This is because the drives for these rolls and their support all pivot as a unit with the housing of the gear box 48. This means that the operator can preliminarily select the angles a and b during the set up of the apparatus, and then further adjust these angles, and therefore the degree of skewing of the matrix, while the machine is running to achieve optimum conditions which will vary from job to job depending on the configuration of the matrix and other factors.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

I claim:

1. In a machine for the processing of a continuous laminated web, such as in the production of labels and the like, where the laminae is die cut to define a matrix portion to be separated from a substrate, a stripper apparatus for separating the matrix from the substrate as the web travels, said apparatus comprising: means for separating the matrix at a skewing angle relative the web, as the web travels.

2. In a machine for the processing of a continuous web, such as in the production of labels or the like, where the laminae is die cut to define a matrix portion to be separated from a substrate, a stripper apparatus for separating the matrix from the substrate as the web travels, said apparatus comprising a stripper bar disposed generally parallel to the plane of the web at the location of said bar and mounted for pivotal movement about an axis generally normal to said plane, and means for securing said stripper bar in a selected pivotal position, said matrix passing partially around said stripper bar away from said substrate.

3. In a machine for the processing of a continuous web, such as in the production of labels or the like, where the laminae is die cut to define a matrix portion to be separated from a substrate, a stripper apparatus for separating the matrix from the substrate as the web travels, said apparatus comprising a stripper bar disposed generally parallel to the plane of the web at the location of said bar and mounted for pivotal movement about an axis generally normal to said plane, means for securing said stripper bar in a selected pivotal position, a rewind roll disposed generally parallel to the plane of the web and mounted for rotation about its longitudinal axis and for pivotal movement about an axis generally normal to said plane, said matrix passing partially around said stripper bar away from said substrate and being rewound onto said rewind roll.

4. The apparatus of claim 3 further comprising a second roll mounted for rotation about its longitudinal axis and for pivotal movement about an axis generally normal to said plane, the longitudinal axis of said second roll being parallel to the longitudinal axis of the rewind roll, said matrix passing partially around said second roll.

5. The apparatus of claim 4 wherein the second roll is driven.

6. The apparatus of claim 3 wherein said stripper bar and rewind roll are pivotally mounted about the same axis.

7. The apparatus of claim 4 wherein the stripper bar, rewind roll, and second roll are pivotally mounted about the same axis.

8. The apparatus of claim 4 wherein said rewind roll and second roll are each driven, and said apparatus further comprises means providing pivotal adjustment of said stripper bar and rolls while said rolls are driven.

9. The apparatus of claim 4 further comprising a circular track segment, and means engaging said track segment for adjustably securing said stripper bar and rolls in selected angular positions.

10. The apparatus of claim 9 wherein said track segment is of sufficient length to provide selected adjustment of said stripper bar for a skewing angle of between zero and 45° in at least one direction.

11. The apparatus of claim 10 wherein at least one direction is upstream of the web.

12. The apparatus of claim 4 wherein said rewind and second rolls are driven, and further comprising means for finely adjusting the relative speeds of the web, rewind roll and second roll for selected matrix tension.

13. The apparatus of claim 4 further comprising a third roll mounted for rotation about its longitudinal axis and for pivotal movement about an axis generally normal to said plane, the longitudinal axis of said third roll being parallel to those of said rewind and second rolls, said matrix traveling partly around said third roll.

14. The apparatus of claim 13 wherein said third roll is downstream of said second roll, and said rewind roll is above said second and third rolls.

15. The apparatus of claim 4 wherein the positioning of the stripper bar and second roll is such that the plane of the matrix as it travels therebetween, is approximately parallel to the web at the location of the stripper bar.

16. The apparatus of claim 4 wherein the relative positions of the stripper bar and second roll are such that in processing the web the matrix travels from the substrate, partially around the stripper bar and thereafter partially around the second roll, said matrix being skewed relative the web by an amount defined by the angle of the stripper bar, and the angular position of said second roll relative to an axis in the plane of the web normal to the direction of web travel being adjustable to approximately twice the skewing angle.

17. In a machine for the processing of a continuous laminated web, such as in the production of labels and the like, where the laminae is die cut to define a matrix portion to be separated from a substrate, a stripper apparatus for separating the matrix from the substrate as the web travels, said apparatus comprising: a frame along which said web travels, a stripper bar disposed generally parallel, and mounted for pivotal movement about an axis generally normal, to the plane of the web at the location of said bar, a support mounted for pivotal movement about an axis generally normal to said web plane, a rewind roll upon which said matrix is rewound disposed generally parallel to said web plane and mounted to said support for rotation about its longitudinal axis, a second roll mounted to said support for rotation about its longitudinal axis, the longitudinal axis of said second roll being parallel to the longitudinal axis of the rewind roll, means for securing said support and stripper bar in selected pivotal positions, and said matrix passing partially around said stripper bar away from said substrate, partially around said second roll, and onto said rewind roll.

18. The apparatus of claim 17 further comprising a third roll mounted to said support for rotation about its longitudinal axis, the longitudinal axis of said third roll being parallel to those of said rewind and second rolls, said matrix traveling partially around said third roll as it travels between said stripper bar and rewind roll.

19. The apparatus of claim 18 wherein the matrix travels partially around said third roll as it travels between said second roll and rewind roll.

20. The apparatus of claim 18 wherein said third roll is downstream of said second roll and said rewind roll is above said second and third rolls.

21. The apparatus of claim 17 wherein the rewind and second rolls are driven.

22. The apparatus of claim 17 wherein the support and stripper bar are pivotally mounted about the same axis.

23. The apparatus of claim 17 wherein the rewind roll and second roll are driven, and said apparatus further comprises means for pivotal adjustment of said support and stripper bar while said rolls are driven.

24. The apparatus of claim 17 further comprising track segment means and means engaging said track segment for securing said support and stripper bar in selected angular positions.

25. The apparatus of claim 17 wherein said stripper bar is selectively adjustable for a skewing angle of at least between zero and 25° in at least one direction.

26. The apparatus of claim 25 wherein said support is selectively pivotally adjustable to an angle approximately twice the skewing angle.

27. The apparatus of claim 25 wherein said at least one direction is upstream of the web.

28. The apparatus of claim 23 further comprising means for finely adjusting the relative speeds of the web, rewind roll, and second roll for selected matrix tension.

29. The apparatus of claim 23 wherein the drive means further comprises a gear drive having a housing and input and output shafts, said gear drive being mounted to said frame for rotation of said input shaft relative said housing, and pivotal movement of said housing relative said frame about the axis of said input shaft, said support being mounted to said housing for pivotal movement therewith, and means for driving said rewind and second rolls from the gear drive output shaft.

30. The apparatus of claim 17 wherein the positioning of the stripper bar and second roll is such that the plane of the matrix, as it travels therebetween, is approximately parallel to the web at the location of the stripper bar.

31. The apparatus of claim 30 wherein the positioning of the second and third rolls is such that the plane of the matrix as it travels therebetween is approximately parallel to the web at the location of the stripper bar.

32. The apparatus of claim 17 wherein the relative positions of the stripper bar and second roll are such that in processing the web the matrix travels from the substrate, partially around the stripper bar and thereafter partially around the second roll, said matrix being skewed relative the web by an amount defined by the angle of the stripper bar, and the angular position of said support relative to an axis in the plane of the web normal to the direction of web travel being adjustable to approximately twice the skewing angle.

33. In the processing of a continuous laminated paper web, such as in the production of labels and the like, where the laminae is die cut to define a matrix portion to be separated from a substrate, a method of stripping the matrix from the substrate as the web travels, said method comprising the steps of, separating the matrix from the substrate, and skewing the matrix as it is separated therefrom.

34. The method of claim 33 further comprising the step of rewinding the skewed matrix onto a rewind roll.

35. The method of claim 34 further comprising the step of passing the matrix partially around a second roll as it travels between said web and rewind roll.

36. The method of claim 35 further comprising the step of passing the matrix partially around a third roll as it travels between said second and rewind rolls, the rotational axes of said rewind, second and third rolls being parallel.

37. The method of claim 33 wherein the skewing step further comprises the step of passing the matrix as it separates from the substrate partially around a stripper bar to skew the matrix by an amount defined by the angle of the bar.

38. In the processing of a continuous laminated web, such as in the production of labels or the like, where the laminae is die cut to define a matrix portion to be separated from a substrate, a method of stripping the matrix from its substrate as the web travels, comprising the steps of driving the web past a stripper bar pivotally mounted about an axis generally normal to the plane of the web at the location of the bar, pivotally adjusting the stripper bar to a desired skewing angle, separating the matrix from the substrate and passing the matrix partially around the stripper bar to skew the matrix relative the web by an amount defined by the skewing angle, passing the matrix around a second roll and onto a rewind roll, said second roll and rewind roll being rotationally driven and being pivotally mounted for movement about an axis generally normal to the web at the location of the bar, and pivotally adjusting the second roll to an angular position relative an axis in the plane of the web normal to the direction of web travel of approximately twice the skewing angle.

39. The method of claim 38 further comprising the step of passing the matrix partially around a third roll as it travels between said second and rewind rolls.

40. The method of claim 38 wherein the plane of the matrix as it travels between the stripper bar and second roll is approximately parallel to the web at the location of the stripper bar.

41. The method of claim 38 further comprising the step of adjusting the relative speed of the web, second roll and rewind roll for desired matrix tension.

42. In the processing of a continuous laminated paper web, such as in the production of labels and the like, where the laminae is die cut to define a matrix portion to be separated from a substrate, a method of stripping the matrix from the substrate as the web travels, said method comprising the steps of separating the matrix from the substrate, skewing the matrix as it is separated therefrom, rewinding the skewed matrix onto a rewind roll, passing the matrix partially around a second roll as it travels between said web and rewind roll, adjusting the skewing angle of the matrix, and adjusting the angle of the second roll relative an axis in the plane of the web normal to the direction of web travel to approximately twice the skewing angle.

43. In the processing of a continuous laminated paper web, such as in the production of labels and the like, where the laminae is die cut to define a matrix portion to be separated from a substrate, a method of stripping the matrix from the substrate as the web travels, said method comprising the steps of separating the matrix from the substrate, skewing the matrix as it is separated therefrom, rewinding the skewed matrix onto a rewind roll, passing the matrix partially around a second roll as it travels between said web and rewind roll, and driving said rewind and second rolls.

* * * * *